US011203048B2

(12) United States Patent
Foley

(10) Patent No.: US 11,203,048 B2
(45) Date of Patent: Dec. 21, 2021

(54) VACUUM VESSELS FOR MELTING VEGETABLE OIL GUMS AND ASSOCIATED METHODS OF USE

(71) Applicant: Andrew Foley, St. Louis, MO (US)

(72) Inventor: Andrew Foley, St. Louis, MO (US)

( * ) Notice: Subject to any disclaimer, the term of this patent is extended or adjusted under 35 U.S.C. 154(b) by 198 days.

(21) Appl. No.: 16/432,665

(22) Filed: Jun. 5, 2019

(65) Prior Publication Data

US 2020/0384513 A1 Dec. 10, 2020

(51) Int. Cl.
*B08B 5/04* (2006.01)
*B08B 9/08* (2006.01)

(52) U.S. Cl.
CPC *B08B 9/08* (2013.01); *B08B 5/04* (2013.01); *B08B 2209/08* (2013.01)

(58) Field of Classification Search
CPC ..... B08B 9/08; B08B 5/04; B08B 2209/08; B08B 9/0933
USPC ..... 137/15.01, 899, 345, 346, 348, 351, 137/565.23; 134/30, 35, 40, 45, 66, 90, 134/107, 123, 186, 5, 21, 22.15
See application file for complete search history.

(56) References Cited

U.S. PATENT DOCUMENTS 2,960,106 A * 11/1960 Dyer ..... B64F 1/28 137/351
3,874,399 A * 4/1975 Ishihara ..... B67D 9/02 137/13
4,159,949 A * 7/1979 Oden ..... B01D 21/0012 210/180
4,206,001 A * 6/1980 Knowlton ..... C10G 1/04 134/12
4,770,793 A * 9/1988 Treffry-Goatley ..... B01D 63/06 210/769
5,098,580 A * 3/1992 Andersen ..... B67D 7/76 210/745
5,306,351 A * 4/1994 Anderson ..... B01F 17/0085 134/22.18
5,421,362 A * 6/1995 Sordello ..... B60R 15/00 137/334
5,421,903 A * 6/1995 Manabe ..... B08B 9/0933 134/22.1
5,531,188 A * 7/1996 Tomasulo ..... B08B 9/093 122/379
5,561,883 A * 10/1996 Landry ..... B08B 9/051 15/302
5,674,324 A * 10/1997 Ignasiak ..... B09B 3/0091 134/10
6,258,332 B1 * 7/2001 Johnson ..... B01D 1/0047 196/14.52
6,673,231 B2 * 1/2004 Kim ..... B08B 9/093 134/22.19

(Continued)

*Primary Examiner* — Minh Q Le
(74) *Attorney, Agent, or Firm* — Lewis Rice LLC

(57) ABSTRACT

A system and method for removing vegetable gums from a vegetable oil tank for subsequent reuse is provided, as well as methods of using the same. The system and method of removing vegetable gums from a vegetable oil storage tank may provide the storage tank including the vegetable gums; provide a holding tank comprising a heating element; suck the vegetable gums up from the storage tank into a first conduit; transport the vegetable gums to the holding tank via the first conduit; and heat the vegetable gums in the holding tank, wherein the holding tank is configured to facilitate movement of the holding tank.

12 Claims, 3 Drawing Sheets

(56) References Cited

U.S. PATENT DOCUMENTS

| | | | | |
|---|---|---|---|---|
| 6,834,679 | B2 * | 12/2004 | Briggs | B08B 9/00 137/343 |
| 7,959,012 | B2 * | 6/2011 | Ivan | B01D 21/2461 210/512.1 |
| 7,959,741 | B2 * | 6/2011 | Green | B08B 9/08 134/24 |
| 8,795,436 | B2 * | 8/2014 | Yanagawa | B08B 3/022 134/10 |
| 10,589,287 | B2 * | 3/2020 | Harman | E21B 43/40 |
| 2007/0187322 | A1 * | 8/2007 | McNaughton | B08B 9/0933 210/519 |

* cited by examiner

VACUUM VESSELS FOR MELTING VEGETABLE OIL GUMS AND ASSOCIATED METHODS OF USE

BACKGROUND OF THE INVENTION

1. Field of the Invention

This disclosure is related to the field of vegetable oil processing and the cleaning of equipment used in vegetable oil processing. More particularly to systems and methods for extracting vegetable gums from vegetable oil storage tanks and melting or liquefying the vegetable gums for reuse.

2. Description of the Related Art

Vegetables capable of producing oils have been cultivated and harvested for thousands of years. For example, soybeans have been used as a source of oil and other products for centuries. Although soybeans were first an important agricultural crop in Asia, soybeans were introduced to Europe and the Americas several hundred years ago. Today, soybeans are an important agricultural crop in the United States. Soybeans have been cultivated both as a food source and as a source of oil, meal for feedstock, industrial products, and other uses. Soybeans have been recognized for their nutrition value and for the stunning number of uses for their byproducts when processed. Other sources of vegetable oil include, without limitation, corn, sunflower, cottonseed, rapeseed (canola oil), and the like.

Like other vegetables, the processing of soybeans into soybean oil has been a practice for many years. Today, processing soybeans begins with drying and dehulling using methods known in the art. Once the soybeans are separated from their hulls, the moisture content of the soybeans is adjusted to ensure that the soybeans will process correctly. The soybeans are also heat tempered to prepare the oils and proteins therein for processing. Typically, these prepared soybeans are then rolled into flakes. At this point, generally two processes may be used to extract oil: (1) mechanical pressing and (2) chemical extraction. For mechanical pressing, the soybeans are pressed using a machine, such as a screw press, resulting in the oils being squeezed out of the soybeans by the pressing process. This is the historical method of extracting oils from soybeans and has limited yields. For chemical extraction, a solvent, which is typically hexane, is used to extract the soybean oil. After extraction, the hexane is removed from the soybean oil, and the soybean oil may subsequently be further refined. At the end of either extraction method, the extraction process yields crude soybean oil.

Crude soybean oil, like most vegetable oils, is typically not free of impurities. In fact, crude soybean oil typically contains many oil-insoluble and oil-soluble impurities that may be removed as needed. For the oil-insoluble materials, these often are removed using filtration or other similar processes known in the art. For the oil-soluble materials, these may often be removed using a variety of different processes, including, without limitation, degumming, oil refining, bleaching, and other processes known in the art. The resulting oils may then be blended with other oils or hydrogenated.

At various stages of the soybean oil extraction process, impure soybean oil will typically be held in large tanks for periods of time, which periods may be months or even years. When the soybean oil includes solid materials, these solid materials will typically separate from the oil and fall to the bottom of the storage tanks. This separation is typically due to the relative differences in the densities of the oil and solids. The material that collects at the bottom of the storage tanks may be referred to in the soybean oil processing industry as gums, foots, or bottoms. Storage tanks for other vegetable oils typically collect similar vegetable gums.

These vegetable gums historically have had little value to the processing facilities or their customers, due at least in part to the difficulty in handling the vegetable gum material. In many cases, this vegetable gum material was discarded as waste, which would add a disposal cost for the processing facility. Further, the disposal constitutes significant volumes of waste for landfills or other waste collection facilities.

When vegetable oil storage tanks are cleaned, which could be for a variety of reasons (including, without limitation, testing of storage tank integrity, change of product being processed on the relevant processing line, contamination of product in the relevant processing line, closing of the storage tank), the costs of removal of the vegetable gums is one of the most expensive costs in the vegetable oil storage tank cleaning process. And again, the waste constitutes a significant volume.

The typical vegetable oil storage tank cleaning process in the vegetable oil industry utilizes an industrial vacuum (whether a standalone or as part of a vacuum truck) to suck the vegetable gums out of the storage tank being cleaned. Typically, a water blaster is used to cut up the vegetable gums before it is removed, at least because the vegetable gums are sticky and difficult to remove. The agitation and breakdown of the vegetable gums using a water blaster also typically aids in the flow of the vegetable gum material towards the vacuum. In the majority of storage tank cleaning applications, there is an intermediary storage vessel, or holding tank, used to contain the removed vegetable gum material.

These intermediary storage vessels often take the form of vacuum boxes, which vacuum boxes are large, rectangular, metal boxes that are completely sealed (and potentially reinforced) to ensure that the vacuum boxes will hold a vacuum. When held in the intermediary storage vessels, the vegetable gums are typically too hard or viscous to pump, so they must be dumped somewhere. That the vegetable gums must be dumped limits how the vegetable gums may be subsequently processed, even though the vegetable gums likely continue to contain valuable products. These intermediary storage vessels are then typically used to transport the removed vegetable gums to a landfill or digester, which may be used to make or extract secondary materials for industrial or other applications.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a method of removing vegetable gums from a vegetable oil storage tank that: provides the storage tank including the vegetable gums; provides a holding tank comprising a heating element; sucks the vegetable gums up from the storage tank into a first conduit; transports the vegetable gums to the holding tank via the first conduit; and heats the vegetable gums in the holding tank, wherein the holding tank is configured to facilitate movement of the holding tank.

In an embodiment of the method, the vegetable gums are heated to and maintained at a temperature within a range of about 100 degrees to 200 degrees Fahrenheit. Further, the heating element may comprise steam pipes, and the vegetable gums may be heated to and maintained at a temperature within a range of about 100 degrees to 200 degrees Fahrenheit by moderating an amount of steam introduced into the steam pipes.

In an embodiment of the method, the heated vegetable gums may be expelled from the holding tank using a pump.

In an embodiment of the method, the vegetable gums may be processed to remove vegetable oils.

In an embodiment of the method, the holding tank may further comprise a plurality of wheels, and the step of providing the holding tank may further comprise rolling the holding tank to a location proximate to the storage tank.

There is described herein, in an embodiment, a system for removing vegetable gums from a vegetable oil storage tank, comprising: a holding tank, the holding tank comprising a heating element; a vacuum source; a first conduit having a first end connected to the holding tank; and a second conduit connected between the holding tank and the vacuum source, wherein the vacuum source is configured to create a negative pressure at a second end of the first conduit, and wherein the holding tank is configured to facilitate movement of the holding tank.

In an embodiment of the system, the holding tank is configured to be towed.

In an embodiment of the system, the holding tank and the vacuum source are mounted on a shared structure.

In an embodiment of the system, the heating element comprises steam pipes, and further, the steam pipes may be formed into coils.

In an embodiment of the system, the holding tank further comprises a plurality of wheels.

DETAILED DESCRIPTION OF THE PREFERRED EMBODIMENT(S)

This disclosure is focused on a system for removing vegetable gums from a vegetable oil tank for subsequent reuse, as well as methods of using the same. The system for removing and reusing vegetable oil gums is particularly well suited for use with soybean oils, but may be used for any storage tank, other container, or product having vegetable oils on or therein. Such vegetable oils include, without limitation, corn, sunflower, cottonseed, olive, palm, rice bran, peanut, coconut, and canola oil.

Figure 1:
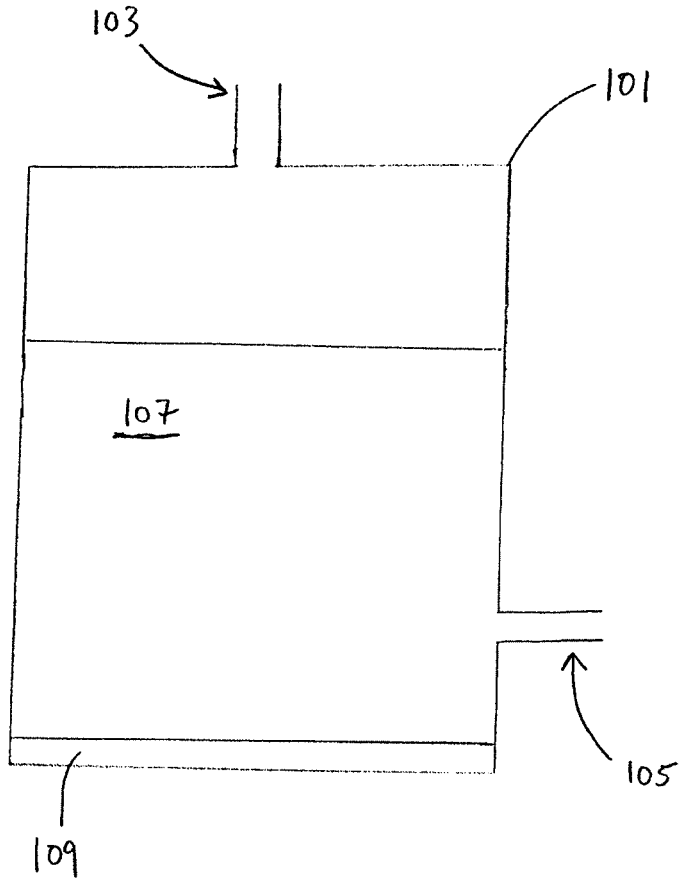
FIG. 1 depicts a storage tank for vegetable oils including vegetable gums.

FIG. 1 shows a storage tank (101) for storing a vegetable oil (107), which is soybean oil in the depicted embodiment. The vegetable oil (107) may be any vegetable oil. Typically, the vegetable oil (107) is a partially refined oil having impurities, such as vegetable gums. The storage tank (101) may have any shape and may be any size. In the depicted embodiment, the storage tank (101) is generally cylindrical. The storage tank (101) may be completely enclosed during use, or alternatively, may have open portions. In any case, the storage tank (101) is capable of facilitating access by cleaning personnel to the interior of the storage tank (101).

The storage tank (101) has built up a layer of vegetable gums (109) over time. The vegetable gums (109) may settle at the bottom of the storage tank (101) because the vegetable gums (109) generally are denser than the relatively lighter vegetable oil (107). However, some amount of vegetable gums (109) may remain in the vegetable oil (107), and the vegetable gums (109) typically contain some vegetable oil (107). The storage tank (101) also includes an inlet (103) for receiving vegetable oil (107) and an outlet (105) for distributing the stored vegetable oil (107).

Figure 2:
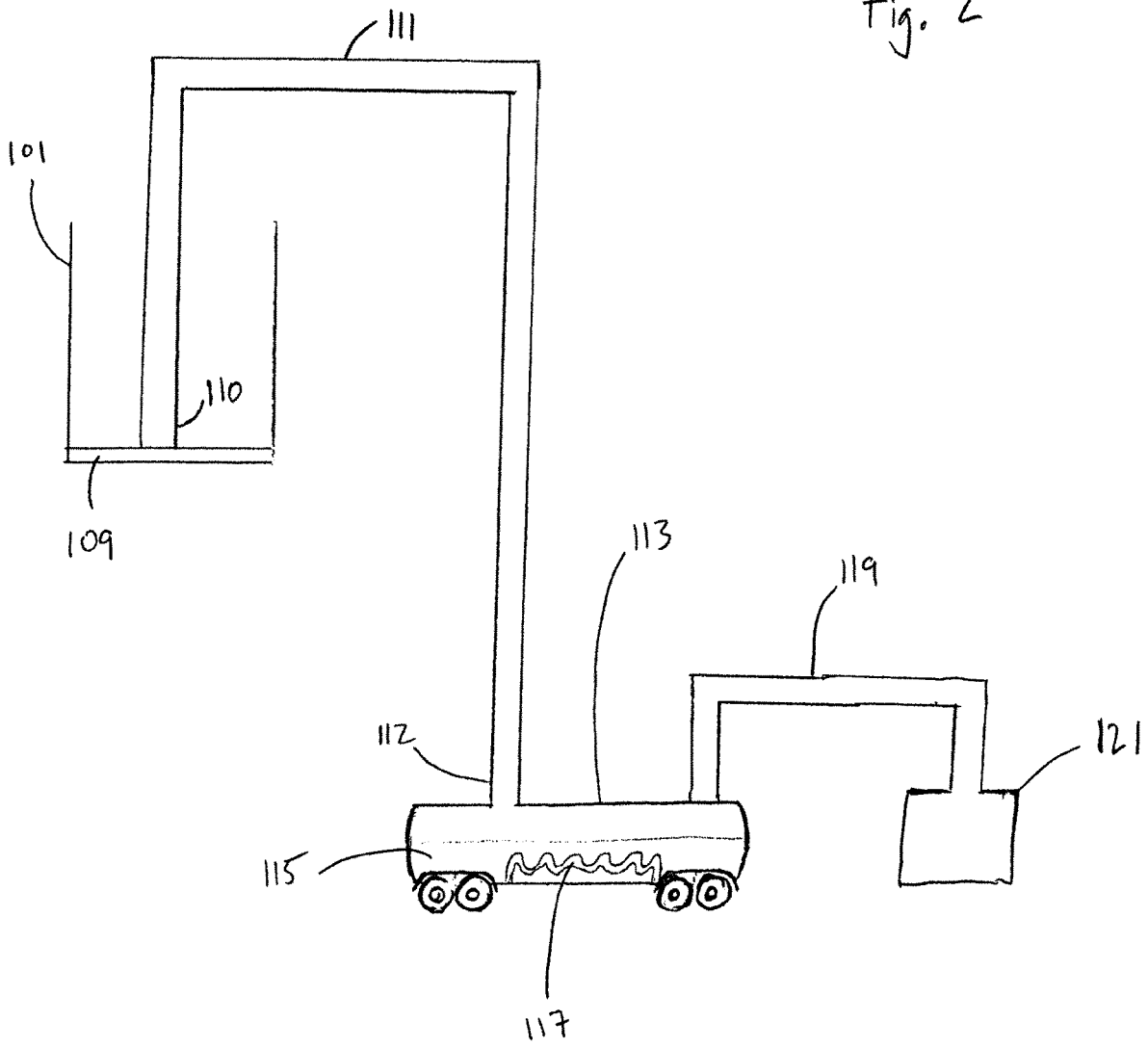
FIG. 2 depicts an embodiment of a system for removing and reusing vegetable gums.

FIG. 2 illustrates an embodiment of a system for removing vegetable gums (109) from a storage tank (101) for subsequent reuse. In the depicted embodiment, the storage tank (101) has had most of its vegetable oil (107) removed, leaving the vegetable gums (109) at the bottom of the storage tank (101). Additionally, the vegetable gums (109) may be broken up using jets of water, separating the vegetable gums (109) from the walls and bottom of the storage tank (101). This process may leave a slurry or suspension of water and separated vegetable gums (109) within the storage tank (101).

A first end (110) of a first conduit (111) is placed proximate to the vegetable gums (109) within the storage tank (101). The second end (112) of the first conduit (111) is connected to a holding tank (113). The first conduit (111) may be formed of any material capable of carrying the vegetable gums (109) from the storage tank (101) to the holding tank (113). For example, the first conduit (111) may be made of a flexible material, such as rubber, with rigid internal reinforcements to prevent collapse due to vacuum pressure. In another embodiment, the first conduit (111) may be formed from interlocking plastic sections that allow for some flexibility while remaining at least semi-rigid in shape. Any material or combination of materials known in the art may be used to form the first conduit (111).

The holding tank (113) will typically be moveable to facilitate moving the holding tank (113) to a location proximate to a storage tank (101) being cleaned and to other locations for subsequent processing of the retrieved vegetable gums and other materials. For example, the holding tank (113) may be constructed to include wheels to facilitate being moved. In some embodiments, the holding tank (113) having wheels may be capable of being towed by another vehicle, allowing the holding tank (113) to be easily moved. In another embodiment, the holding tank (113) may be integrated with a vehicle. In yet another embodiment, the holding tank (113) may be constructed without wheels. In such an embodiment, the holding tank (113) will generally be capable of being placed onto a vehicle or moving platform to be moved. In any case, the holding tank (113) will be generally be capable of being moved from near the storage tank (101) to a separate location.

In order to clean the storage tank (101), the vegetable gums (109) may be sucked into the holding tank (113) from the storage tank (101) using a vacuum source (121). The vacuum source (121) may be connected to the holding tank via a second conduit (119). The second conduit (119) may be formed of the same materials as is the first conduit (111).

Alternatively, the second conduit (119) may be formed of materials different from those of the first conduit (111).

The vacuum source (121) may be any source capable of creating sufficient negative air pressure to suck out the vegetable gums (109) from the storage tank (101) and transport the removed vegetable gums (109) to the holding tank (113). Such vacuum sources (121) include, without limitation, sliding vane pumps, liquid ring pumps, diaphragm pumps, or blowers. The vacuum source (121) may, alternatively, be replaced with a means for creating a negative pressure, as known by persons of ordinary skill in the art. Additionally, the action and force of the vacuum source (121) may further break up or agitate the vegetable gums (109).

In the depicted embodiment, the vacuum source (121) may be separate from the holding tank (113). In alternate embodiments, the vacuum source (121) may be integrated into the holding tank (113) or into a structure related to the holding tank (113). For example, the vacuum source (121) may be integrated onto the same vehicle or platform as the holding tank (113).

The holding tank (113) may include a heating element (117). In the depicted embodiment, the heating element (117) comprises steam pipes. The steam pipes (117) may be formed in any number, orientation, or shape suitable to heat the vegetable gums (109). In an embodiment, the steam pipes (117) are formed in the shape of coils to increase the density of the steam pipes (117) within the holding tank (113). These steam pipes (117) may be fed a stream of steam, as needed, to heat and liquefy any vegetable gums (109) present in the holding tank (113). In other embodiments, the heating element (117) may be pipes holding another material capable of communicating heat, as known in the art. In other embodiments, the heating element (117) may be electrical, or may use any other heating method known in the art.

Figures 3, 4, 5:
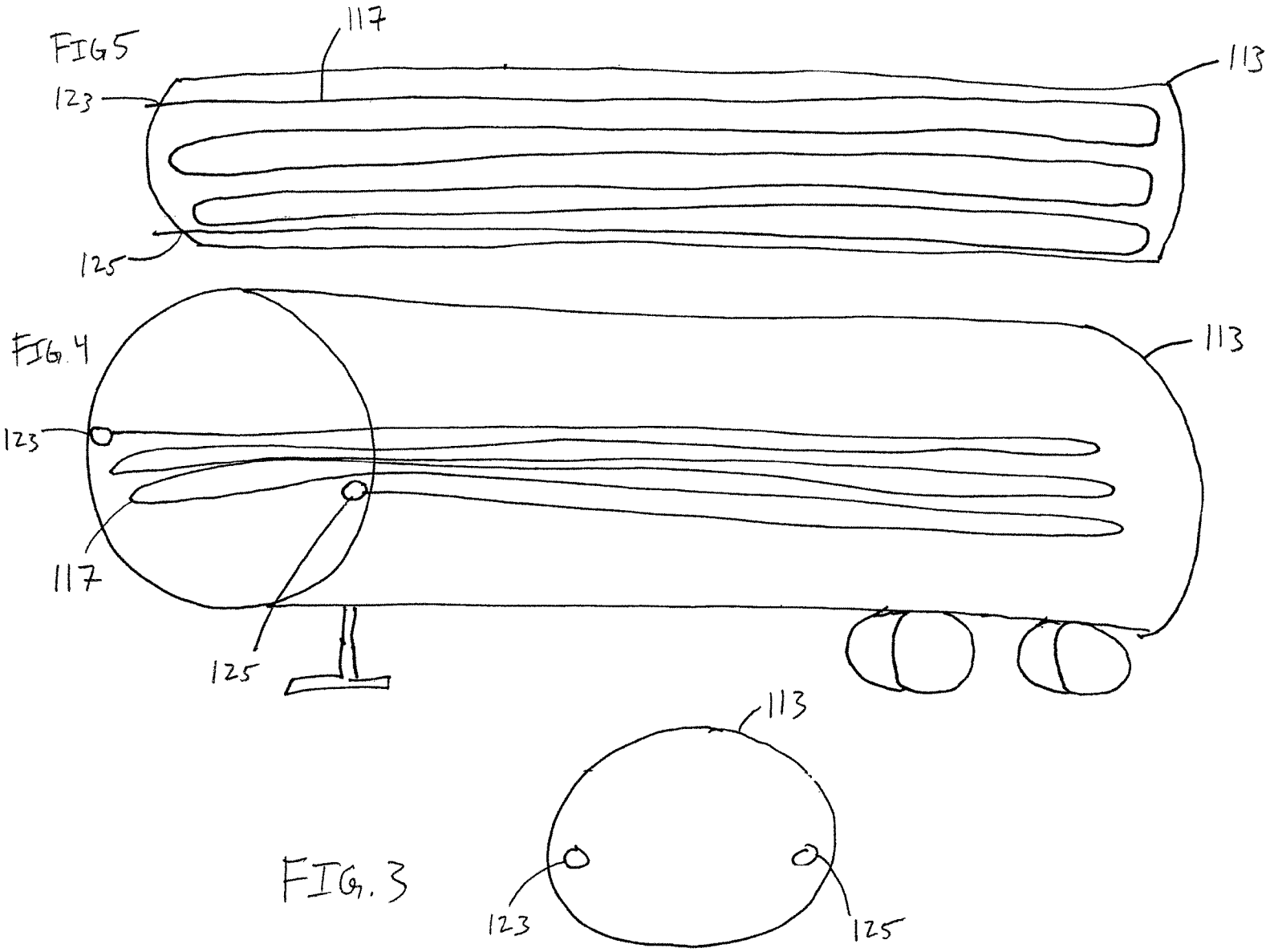
FIG. 3 depicts an embodiment of a holding tank from a side view.
FIG. 4 depicts a perspective view of the holding tank depicted in FIG. 3.
FIG. 5 depicts an interior plan view of the holding tank depicted in FIG. 3.

FIGS. 3-5 show an embodiment of a holding tank (113). FIG. 3 shows a side view of the holding tank (113), wherein the holding tank (113) includes a heating substance inlet (123) and a heating substance outlet (125). In an exemplary embodiment, the heating substance inlet (123) is the start of heating element (117) and the heating substance outlet (125) is the end of the heating element (117). In use, a heating substance, such as steam or any other material known in the art, is inserted into the heating inlet (123). The heating substance may be inserted, for example, by pumping the heating substance into the heating substance inlet (123). The heating substance will typically then move through at least a portion of the heating element (117) and exit the holding tank (113) at the heating substance outlet (125). The path of the heating substance through the heating element (117) is shown in FIGS. 4 and 5. In the depicted embodiment, the heating element (117) winds through the holding tank (113), allowing for efficient heat transfer to any substance within the holding tank (113). In the depicted embodiment, the heating element (117) is arranged generally along a plane, winding in two dimensions. However, any arrangement of the heating element (117) within the holding tank (113) may be used.

The holding tank (113) is constructed to be capable of holding the heated and liquefied vegetable gums (115). The heated and liquefied vegetable gums (115) may include, in addition to vegetable gums (109), some vegetable oil (107), water used when breaking up the vegetable gums (109) within the storage tank (101), and other substances and impurities known in the art to be present in vegetable gums.

A method of using the disclosed system for removing and reusing vegetable gums will now be described. The following steps are intended to be illustrative of an embodiment of the method, and may be conducted in alternate orders. First, a storage tank (101) is placed into a processing line for processing vegetable oil (107), which oil may be, for example, soybean oil. In other examples, the vegetable oil being processed may be any vegetable oil known in the art, including, without limitation, corn, sunflower, cottonseed, olive, palm, rice bran, peanut, coconut, and canola oil.

Next, some vegetable oil (107) is introduced into the storage tank (101). This vegetable oil (107) may be allowed to rest for a period of time in the storage tank (101). The amount of rest time may vary. Periodically, the vegetable oil (107) will be removed from the storage tank (101). The removal may be for further processing of the vegetable oil (107) or for otherwise moving the vegetable oil (107) to another location. The storage tank (101) will be used, off and on, for a period of time to hold and store the vegetable oil (107) during the processing of the vegetable oil (107). During this time, vegetable gums (109) will fall out from the vegetable oil (107) and settle at the bottom of the storage tank (101). This separation is typically due to the effects of gravity on the vegetable gums (109), which tend to be denser than the vegetable oil (107). Over time, the vegetable gums (109) will grow in extent, and will form a layer of sediment at the bottom of the storage tank (101). At some point, for various reasons, the storage tank (101) may be selected for cleaning.

During cleaning of the storage tank (101), typically the vegetable oil (107) is first removed from the storage tank (101). This removal of the vegetable oil (107) will typically leave the vegetable gums (109) that have settled at the bottom of the storage tank (101). The cleaning process for the storage tank (101) will then typically proceed to the removal of the vegetable gums (109).

The vegetable gums (109) are typically first loosened from the storage tank (101) walls and bottom by using a pressurized jet of water to mechanically break up the vegetable gums (109) and separate the vegetable gums (109) from the walls and bottom of the storage tank (101). This process is typically conducted using a water blaster that is handheld by a cleaning technician, however, any process of freeing the vegetable gums (109) from the walls and bottom of the storage tank (101) known in the art may be used. The typical result of this sub-process is a slurry or suspension of vegetable gums (109) that were mechanically separated from the storage tank (101) with the water used to separate the vegetable gums (109) residing within the storage tank (101).

Next, a holding tank (113) is placed proximate to the storage tank (101). The distance between the holding tank (113) and the storage tank (101) may be limited by, for example, the limited ability of a vacuum to suck material due to the limited nature of air pressure and the friction or other losses within the pumping system, as is known in the art. Once the holding tank (113) is placed, the first conduit (111) may be placed to connect the storage tank (101) and the holding tank (113). Further, the second conduit (119) may be placed to connect the holding tank (113) to the vacuum source (121). Once the first conduit (111) and second conduit (119) are properly placed, the vacuum source (121) may be used to apply a negative pressure to the first end (110) of the first conduit (111), which first end (110) is not attached to the holding tank (113).

Once the vacuum source (121) is operational, the first end (110) of the first conduit (111) may be placed in or around the slurry of vegetable gums (109). With the vacuum source (121) creating a negative pressure, the negative pressure is communicated to the first end (110) of the first conduit (111). This, in turn, sucks up the slurry of vegetable gums (109) into the first conduit (111). The slurry of vegetable gums (109) proceeds through the first conduit (111) until it reaches the holding tank (113). The process of sucking the vegetable gums (109) from the storage tank (101) continues until the storage tank (101) is sufficiently emptied, or the holding tank (113) is sufficiently filled.

Once deposited into the holding tank (113), the slurry of vegetable gums (109) may be heated by the heating element (117). Typically, the holding tank (113) will be moved before heating the vegetable gums (109). For example, the holding tank (113) may be moved proximate to a location where the vegetable gums (109) may be further processed, or to where heating substance for the heating element (117) is available, such as a commercial boiler. The heating element (117) may be turned on by, in the depicted embodiment, beginning to feed the steam pipes (117) with steam. The heating element (117) will typically heat the vegetable gums (109) within the holding tank (113) so that they reach and maintain a temperature within a range of about 100 to 230 degrees Fahrenheit. Alternatively, the heating element (117) may heat the vegetable gums (109) within the holding tank (113) to a temperature within a range of about 140 to 180 degrees Fahrenheit. At these temperatures, the semi-rigid, viscous vegetable gums (109) liquefy, and become flowable and pumpable. The heated and liquefied vegetable gums (115) may then be maintained in this liquefied state to be further processed or pumped out of the holding tank (113).

At this point, the holding tank (113) may be again be moved from its current location. In some embodiments, the holding tank (113) will be moved to a place where the liquefied vegetable gums (115) may be further processed to remove potentially valuable vegetable oils, or other materials, remaining in the liquefied vegetable gums (115). In other embodiments, the holding tank (113) may not need to be moved again because the vegetable gums (109) were heated in the same location where the heated vegetable gums (115) will be further processed. Further processing may include, for example, the further processing of the vegetable gums (115) using a solvent, such as hexane, or an acid, such as sulfuric acid. The acid process, for example, separates the vegetable oil and acid into a layer above remaining solids. This is a relatively efficient process. Then, the vegetable oil may be collected, and the liquefied vegetable gums (115) may be discarded or processed further to utilize other components of the vegetable gums (115). This further processing may include, for example, extracting purified vegetable gums for use as a thickening agent or an animal feedstock. Alternatively, the remaining solids may be used as a fertilizer, or in any other manner known in the art. In other embodiments, the liquefied vegetable gums (115) may be discarded without further processing.

In any case, the flowable state of the liquefied vegetable gums (115) eases the process of moving the liquefied vegetable gums (115) from the holding tank (113) at least because the material may be pumped.

In other embodiments, the holding tank (113), the first conduit (111), and/or the second conduit (119) may be placed in a different order than discussed above. Further, either of the first conduit (111) and the second conduit (119), or both, may be replaced by any physical connections that allow a negative pressure to be communicated from the vacuum source (121) to the holding tank (113), and then to the storage tank (101). Further, the first conduit (111) or any substitute generally will be capable of carrying the slurry of vegetable gums (109) from the storage tank (101) to the holding tank (113).

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "cylindrical" are purely geometric constructs and no real-world component is a true "cylindrical" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A method of removing vegetable gums from a vegetable oil storage tank, comprising:

providing said storage tank including said vegetable gums;

providing a holding tank comprising a heating element;

providing a vacuum source connected to the holding tank;

said vacuum source sucking said vegetable gums up from said storage tank into a first conduit;

transporting said vegetable gums to said holding tank via said first conduit; and said heating element heating said vegetable gums in said holding tank;

wherein said holding tank is configured to facilitate movement of said holding tank, and wherein said holding tank is positioned between said first conduit and said vacuum source.

2. The method of claim 1, wherein said vegetable gums are heated to and maintained at a temperature within a range of about 100 degrees to 200 degrees Fahrenheit.

3. The method of claim 2, wherein said heating element comprises steam pipes, and said vegetable gums are heated to and maintained at a temperature within a range of about 100 degrees to 200 degrees Fahrenheit by moderating an amount of steam introduced into said steam pipes.

4. The method of claim 1, further comprising a step of expelling said heated vegetable gums from said holding tank using a pump.

5. The method of claim 1, further comprising a step of processing said vegetable gums to remove vegetable oils.

6. The method of claim 1, wherein said bolding tank further comprises a plurality of wheels, and the step of providing said holding tank further comprises rolling said holding tank to a location proximate to said storage tank.

7. A system or removing vegetable gums from a vegetable oil storage tank, comprising:

a holding tank, said holding tank comprising a heating element and including said vegetable gums;

a vacuum source;

a first conduit having a first end connected to said holding tank and a second end connected to said holding tank including said vegetable gums; and a second conduit connected between said holding tank and said vacuum source, wherein said vacuum source is configured to create a negative pressure at said second end of said first conduit to suck said vegetables said first conduit, and wherein said holding tank is configured to facilitate movement of said holding tank.

8. The system of removing vegetable gums of claim 7, wherein said holding tank is configured to be towed.

9. The system of removing vegetable gums of claim 7, wherein said holding tank and said vacuum source are mounted on a shared structure.

10. The system of removing vegetable gums of claim 7, wherein said heating element comprises steam pipes.

11. The system of removing vegetable gums of claim 10, wherein said steam pipes are formed into coils.

12. The system of removing vegetable minis of claim 7, wherein said holding tank further comprises a plurality of wheels.

* * * * *